US007267109B2

(12) United States Patent
Boehland et al.

(10) Patent No.: US 7,267,109 B2
(45) Date of Patent: Sep. 11, 2007

(54) FUEL INJECTION DEVICE FOR AN INTERNAL COMBUSTION ENGINE

(75) Inventors: Peter Boehland, Marbach (DE); Hans-Christoph Magel, Pfullingen (DE); Sebastian Kanne, Schwaikheim (DE); Godehard Nentwig, Stuttgart (DE); Michael Bauer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/566,755

(22) PCT Filed: Jun. 9, 2004

(86) PCT No.: PCT/DE2004/001201

§ 371 (c)(1),
(2), (4) Date: Feb. 1, 2006

(87) PCT Pub. No.: WO2005/015003

PCT Pub. Date: Feb. 17, 2005

(65) Prior Publication Data

US 2006/0208106 A1 Sep. 21, 2006

(30) Foreign Application Priority Data

Aug. 1, 2003 (DE) ..... 103 35 211

(51) Int. Cl.
*F02M 59/46* (2006.01)
*F02M 59/44* (2006.01)

(52) U.S. Cl. ..... 123/467; 123/299

(58) Field of Classification Search ..... 123/467, 123/299, 446, 305; 239/88, 90, 91, 533.1, 239/533.12, 444, 533.2, 94, 585.1, 96
See application file for complete search history.

(56) References Cited

U.S. PATENT DOCUMENTS

| | | | | |
|---|---|---|---|---|
| 5,638,791 | A * | 6/1997 | Tsuzuki et al. | 123/467 |
| 5,899,389 | A | 5/1999 | Pataki et al. | |
| 7,021,565 | B2 * | 4/2006 | Coldren et al. | 239/533.2 |
| 2002/0185111 | A1 * | 12/2002 | Boecking | 123/446 |
| 2003/0141389 | A1 | 7/2003 | Boecking | |
| 2005/0173563 | A1 * | 8/2005 | Coldren et al. | 239/533.1 |
| 2006/0144964 | A1 * | 7/2006 | Boecking | 239/533.2 |

FOREIGN PATENT DOCUMENTS

| | | |
|---|---|---|
| DE | 100 06 786 A1 | 8/2001 |
| JP | 2002-322970 | 11/2002 |

* cited by examiner

*Primary Examiner*—Mahmoud Gimie
(74) *Attorney, Agent, or Firm*—Ronald E. Greigg

(57) ABSTRACT

A fuel injection device for an internal combustion engine, having two valve elements each having a hydraulic control surface acting in the closing direction and associated with a hydraulic control chamber. A control valve influences the pressure in the control chamber, and loading devices act on the valve elements in the opening direction. The valve elements react at different hydraulic opening pressures prevailing in the control chamber. The control valve is able to set at least three different pressure levels in the control chamber: all of the valve elements are closed at a comparatively high pressure level; one valve element is open at a medium pressure level; and all of the valve elements are open at a comparatively low pressure level.

20 Claims, 8 Drawing Sheets

FUEL INJECTION DEVICE FOR AN INTERNAL COMBUSTION ENGINE

CROSS REFERENCE TO RELATED APPLICATIONS

This application is a 35 USC 371 application of PCT/DE 2004/001201 filed on Jun. 9, 2004.

BACKGROUND OF THE INVENTION

1. Field of the Invention

The invention relates to a fuel injection device for an internal combustion engine, having at least two valve elements, each of which has a hydraulic control surface acting in the closing direction that is associated with a hydraulic control chamber, having a control valve that influences the pressure in the control chamber, and having loading devices that are able to act on the valve elements in the opening direction, in which the valve elements react at different hydraulic opening pressures prevailing in the control chamber, and to a method for operating a fuel injection device of this kind.

2. Description of the Prior Art

A fuel injection device of the type mentioned at the beginning is known from DE 101 22 241 A1, which discloses an injection nozzle for internal combustion engines having two valve elements situated coaxially relative to each other. Both of the valve elements are stroke-controlled, i.e. they open when the pressure of a hydraulic fluid in a control chamber is reduced. The force of the valve elements acting in the opening direction is generated by an injection pressure acting on a corresponding pressure surface. As a result, the outer valve element opens first, followed by the inner valve element. If only the outer valve element is to be opened, then the pressure reduction in the control chamber must be terminated promptly and the pressure must be increased again.

Fuel injection devices are provided with several valve elements for the following reasons:

In particular in diesel internal combustion engines, in order to reduce emissions and increase efficiency, it is necessary to inject the fuel in as finely atomized a form as possible into the corresponding combustion chambers of the engine. This can be achieved if the fuel travels into the fuel injection device at a high injection pressure.

Using several valve elements, each of which controls a certain number of fuel outlet openings, makes it possible, even if a small fuel quantity is to be injected, to achieve a sufficiently long injection duration with a good atomization quality without simultaneously having to accept an excessively long injection duration and/or an excessively high injection pressure if a large fuel quantity is to be injected.

The object of the present invention is to modify a fuel injection device of the type mentioned at the beginning so that it can be triggered in as simple a fashion as possible and nevertheless functions reliably. At the same time, its use should enable a good emissions and fuel consumption behavior of the associated internal combustion engine. A further object of the present invention is to provide a method of operation of a valve of the type mentioned at the beginning so that even if only one valve element is to be actuated, this occurs as needed in the fastest possible way.

The first object mentioned above is attained in a fuel injection device of this type in that the control valve is able to set at least three different pressure levels in the control chamber; all of the valve elements are closed at a comparatively high pressure level; one valve element is open at a medium pressure level; and all of the valve elements are open at a comparatively low pressure level.

The second object mentioned above is attained in a method of operation of the valve by virtue of the fact that in a fuel injection device of this type, in order to open only one valve element, the control chamber is first connected to a low-pressure connection and then, is simultaneously connected to the low-pressure connection and a high-pressure connection.

SUMMARY AND ADVANTAGES OF THE INVENTION

With the fuel injection device according to the invention, the control chamber can be set to an additional medium pressure level at which the one valve element is already open, but the other valve element remains closed. In this way, it is possible to achieve even longer injection durations with only one open valve element, which, particularly in the partial load range, yields a favorable emissions and fuel consumption behavior of an internal combustion engine into which the fuel injection device according to the invention is incorporated. At the same time, the device is simply designed since it is not necessary to execute separate triggering actions for the valve elements with separate control chambers. It is also possible for the fuel injection device to contain only a single control chamber.

The advantage of the method proposed according to the invention lies in the fact that initially, through the connection of the control chamber to only the low-pressure connection, the pressure in the control chamber is reduced very quickly, but through the subsequent additional connection of the control chamber to the high-pressure connection, this pressure reduction is limited, namely to the level of a corresponding intermediate pressure. The second process step advantageously occurs before the valve element has reached an open end position.

Advantageous modifications of the invention are disclosed. According to a first modification, the control chamber is connected to a high-pressure connection via an inlet throttle and the control valve is connected to the control chamber on the one hand and to a low-pressure connection on the other. In a fuel injection device of this kind, the fuel injection can be completely controlled by means of a simple control valve and only two pressure connections, namely a high-pressure connection and a low-pressure connection. This embodiment is therefore inexpensive and functions reliably.

In a modification of this, the control valve has a switching chamber with a switching element, which rests against a first valve seat leading to the low-pressure connection in a first switched position, rests against a second valve seat leading to a bypass conduit in a second switched position, said bypass conduit being connected to the high-pressure connection, and does not rest against either the first valve seat or the second valve seat in a third switched position. A control valve of this kind is simple and therefore inexpensive.

The bypass conduit makes it possible to set a high, middle, or low fluid pressure in the switching chamber. This correspondingly results in the respective final pressures in the control chamber and correspondingly also results in the speeds with which the pressure in the control chamber falls. Furthermore, the connection of the switching chamber to the high-pressure connection at the end of an injection makes it possible to also connect the control chamber to the high-pressure connection via the switching chamber so that the pressure in the control chamber rises very quickly and the valve elements close quickly. This is particularly advantageous with regard to the emissions behavior.

In another modification of this, in the third switched position, the control valve constitutes a throttle that restricts the flow toward the low-pressure connection. This makes it possible to limit the fuel flow from the high-pressure connection directly to the low-pressure connection. As a result, it is not necessary to supply as much fuel and a smaller fuel pump can be used.

It is also possible for the control chamber to be connected to the high-pressure connection, for the control valve to be connected to the control chamber via at least two control conduits, and for the control valve to disconnect all of the control conduits from a low-pressure connection in a first switched position, to connect one control conduit to the low-pressure connection in a second switched position, and to connect all of the control conduits to the low-pressure connection in a third switched position.

Since the maximum influx of fuel from the high-pressure connection into the control chamber is limited, a higher or lower pressure level occurs in the control chamber depending on the outflow cross section, which is determined by the number of control conduits selected. This makes it possible to set an arbitrary opening time of the other valve element. Particularly under full load, both valve elements are opened directly at the start of injection. This achieves a maximum injection quantity at a given injection duration.

This fuel injection device is technically simple to implement and therefore particularly inexpensive. Fundamentally, it is conceivable for the control conduits to be identical and therefore when the number of control conduits being used is doubled, this doubles the available outlet cross section. However, the control conduits can also be embodied differently from each other, with an entirely specific throttle behavior associated with each control conduit. This makes it possible to set the pressure level prevailing in the control chamber in a very precise fashion.

Another easy-to-implement possibility for achieving different pressure levels in the control chamber is comprised in that the control chamber is connected to a high-pressure connection, the control valve connects the control chamber to a low-pressure connection in a first switched position and disconnects the control chamber from it in a second switched position, and the control valve can be continuously switched back and forth between the first switched position and the second switched position.

In this particularly preferred embodiment of the fuel injection device according to the invention, the setting of the different pressure levels in the control chamber requires only a simple 2/2-way relay valve. In the simplest case, the valve is closed again shortly before the valve element that opens second begins its opening movement (preferably before the valve element that opens first has reached its open end position) and is opened again shortly before the valve element that opens first has closed to such a degree that the emerging flow of fuel is throttled to an impermissible degree. The medium pressure level is thus the average value of a pulsating pressure curve caused by the opening and closing of the control valve. Alternatively, a constant, average pressure level can be set by a rapid succession of opening and closing, for example by means of a pulsed triggering.

According to another advantageous embodiment of the fuel injection device according to the invention, the valve elements are coaxial to each other and an axial boundary surface of the control chamber has a circumferential sealing region which, in an open end position of the outer valve element, subdivides the control chamber into an outer region connected to the high-pressure connection and an inner region connected to the control valve. The coaxial design makes the fuel injection device very compact. In the open end position of the outer valve element, the sealing region disconnects the control chamber region associated with the control surface of the inner valve element from the influx of highly pressurized fuel. The pressure in this control chamber region therefore falls particularly quickly so that the inner valve element opens with a corresponding rapidity. This reduces emissions.

In all of the fuel injection devices mentioned above, it is desirable for the control valve to switch very quickly. This can be achieved in a very simple fashion if the control valve includes a piezoelectric actuator.

In a modification of this, the control valve includes a valve body that is hydraulically coupled to the piezoelectric actuator; leakage fuel emerging from a guide of at least one valve element is used as the hydraulic fluid. The hydraulic coupling makes it possible to amplify the comparatively small stroke of the piezoelectric actuator by means of a hydraulic boosting. A corresponding valve body of the control valve is therefore able to open up a sufficient flow cross section when it opens, without needing to be large in size. By using the leakage fuel, which is present anyway, for the hydraulic coupling, it is possible to eliminate an additional fluid supply. This fuel injection device is therefore compact and comparatively inexpensive.

An additional advantageous embodiment of the fuel injection device according to the invention is distinguished in that one valve element has a catch that acts on the other valve element in the opening direction. This assures that the later-opening valve element opens precisely when the initially opening valve element has traveled a particular stroke distance. In certain load/speed situations in the internal combustion engine, this produces an injection curve in which particularly low emissions are generated. Depending on the pressure in the control chamber, however, the force that the catch exerts on the later-opening valve element may not be sufficient to open it. In this case, the catch functions as a stop that limits the stroke of the initially opening valve element. This makes it possible to inject extremely small fuel quantities.

In a modification of this, the catch is embodied so that it strikes the other valve element shortly before the one valve element reaches its maximum stroke. This assures that on the one hand, only the one valve element can be open so long as it has not yet reached its maximum stroke and on the other hand, the second valve element opens reliably by virtue of the first valve element being moved to the maximum stroke.

In a particularly preferred embodiment of the fuel injection device according to the invention, the loading device, which acts in the opening direction of the other valve element, and the hydraulic control surface of the other valve element are matched to each other so that this valve element opens only if the catch of the one valve element exerts an additional force acting in the opening direction. In order for the second valve element to open, it is therefore necessary not only for a reduction of the pressure in the control chamber to occur, but also for the driving action to be exerted by the valve element that opens first. This makes it possible to embody the control surfaces and the loading devices so that the opening pressures of the valve elements differ quite significantly from each other, which increases the operational reliability of the fuel injection device.

BRIEF DESCRIPTION OF THE DRAWINGS

Particularly preferable exemplary embodiments of the present invention will be explained in detail below, in conjunction with the accompanying drawings, in which.

DESCRIPTION OF THE PREFERRED EMBODIMENTS

Figure 1:
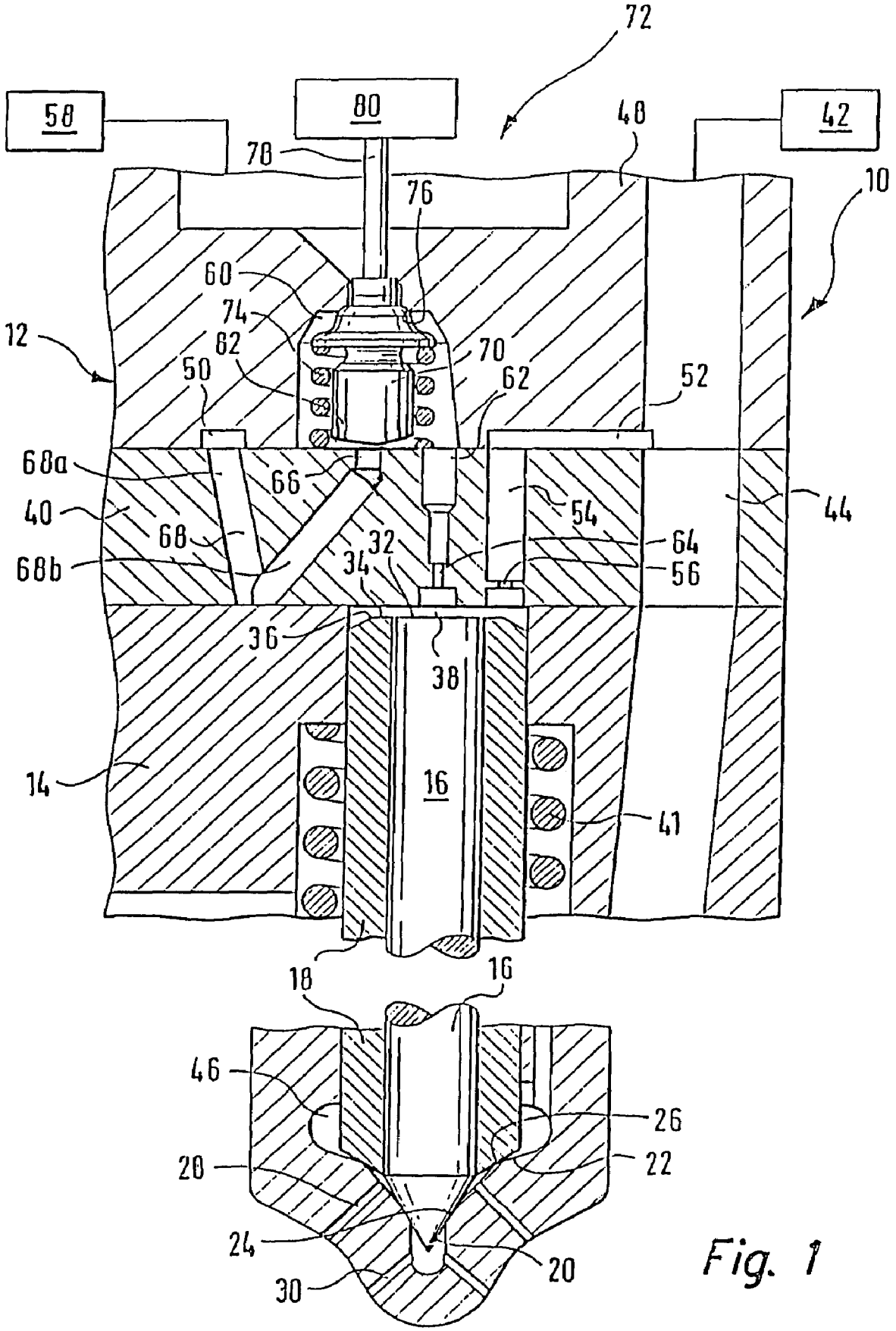
FIG. 1 shows a partial sectional view of regions of a first exemplary embodiment of a fuel injection device with two coaxial valve elements.

In FIG. 1, a fuel injection device as a whole is labeled with the reference numeral 10. It includes a housing 12 that is comprised, among other things, of a nozzle body 14. This nozzle body contains two valve elements 16 and 18 situated coaxially relative to each other. At their ends oriented toward the bottom in FIG. 1, each of the two valve elements 16 and 18 has a conical pressure surface 20, 22 that rests against a corresponding sealing edge 24, 26 on the housing when the valve element 16, 18 is closed. A number of fuel outlet conduits 28 that are distributed around the circumference of the nozzle body 14 lead outward from an annular chamber (unnumbered) situated between the two sealing edges 24 and 26. Fuel outlet conduits 30 that are also distributed around the circumference of the nozzle body 14 lead outward from a blind hole (unnumbered) provided at the lower end of the nozzle body 14.

The end of the inner valve element 16 toward the top in FIG. 1 is embodied in the form of a push rod with a circular end surface 32. If the two valve elements 16 and 18 are resting against the corresponding sealing edges 24 and 26, then a corresponding annular control surface 34 of a push rod of the outer valve element 18 is situated at approximately the same height as the control surface 32 of the inner valve element 16. Part of the annular control surface 34 is conical and is delimited toward the radial inside by a sealing region 36 whose function will be explained in greater detail below. The control surfaces 32 and 34 delimit a shared hydraulic control chamber 38 that is also encompassed by the nozzle body 14 and a counterpart piece 40. A valve spring 41 acts on the outer valve element 18 in the closing direction.

The fuel injection device 10 also has a high-pressure connection 42, depicted only symbolically in FIG. 1, which is usually connected to a fuel accumulator (not shown) of a common rail injection system during operation of the fuel injection device 10. A conduit 44 that extends largely in the longitudinal direction of the fuel injection device 10 leads from the high-pressure connection 42 to an annular pressure chamber 46 at the lower end of the fuel injection device 10, which pressure chamber 46, when the outer valve element 18 is closed, is delimited by the region of the pressure surface 22 of the outer valve element 18 situated radially outside the sealing edge 26.

A housing part 48 situated above the counterpart piece 40 in FIG. 1 has an annular groove 50 let into its end surface oriented toward the counterpart piece 40, which groove 50 is connected to the conduit 44 via a branch conduit 52. The counterpart piece 40 contains a high-pressure conduit 54 that connects the annular groove 50 to the control chamber 38. The high-pressure conduit 54 contains an inlet throttle 56.

The fuel injection device 10 also has a low-pressure connection 58 that is only depicted in schematic form in FIG. 1. During operation of the fuel injection device 10, this low-pressure connection 58 is usually connected to a return line (not shown) that leads back to a fuel tank. During operation of the fuel injection device 10, therefore, approximately atmospheric pressure prevails in the low-pressure connection 58, whereas a very high pressure of up to 2000 bar prevails in the high-pressure connection 42.

The low-pressure connection 58 leads to a switching chamber 60 that will be discussed in further detail below. In the counterpart piece 40, a control conduit 62 leads from the switching chamber 60 to the control chamber 38. An outlet throttle 64 is provided in the control conduit 62. A bypass conduit 68 also leads from the switching chamber 60, through a throttle restriction 66, to the annular groove 50 that communicates with the high-pressure connection 42. The bypass conduit 68 is embodied by means of two bore segments **68*a* and 68*b*** situated at an angle in relation to each other.

The switching chamber 60 contains a cylindrical switching element 70 of a 3/3-way relay valve 72. A valve spring 74 presses the switching element 70 against a first valve seat 76 situated at the end of the switching chamber 60 oriented toward the low-pressure connection 58. The switching element 70 is coupled to an actuating rod 78 that can be actuated by a piezoelectric actuator 80. In this manner, the switching element 70 can be pressed counter to the force of the valve spring 74, against a second valve seat 82 situated at the end of the switching chamber 60 oriented toward the bypass conduit 68.

Figure 2:
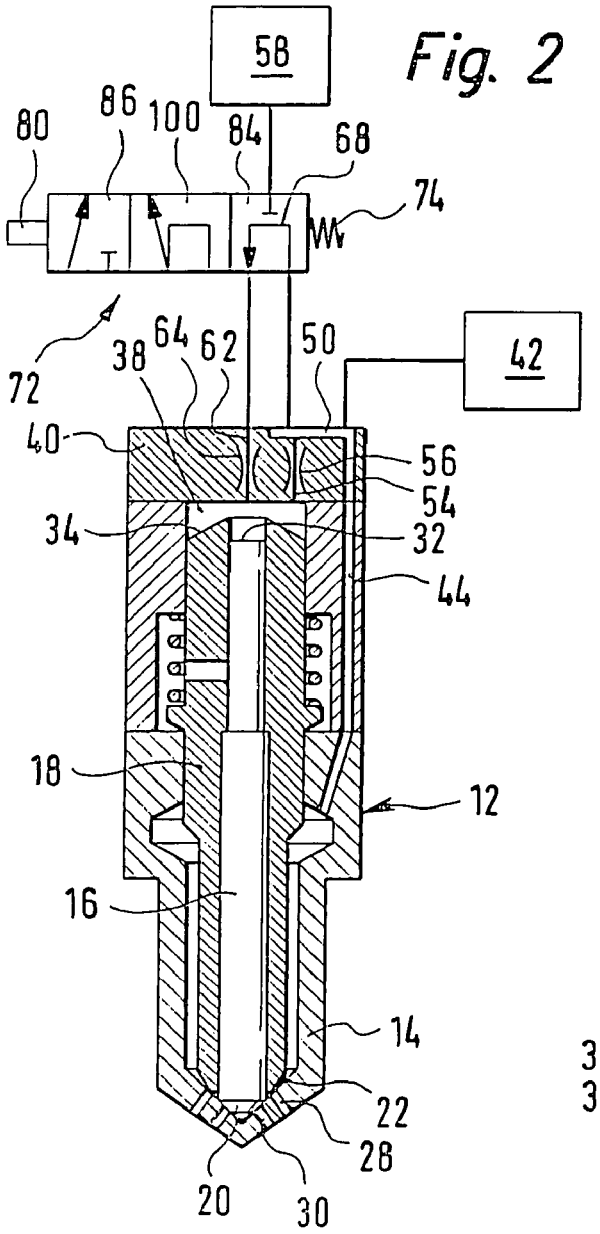
FIG. 2 is a schematic depiction of the fuel injection device from FIG. 1 with the valve elements closed.
Figure 3:
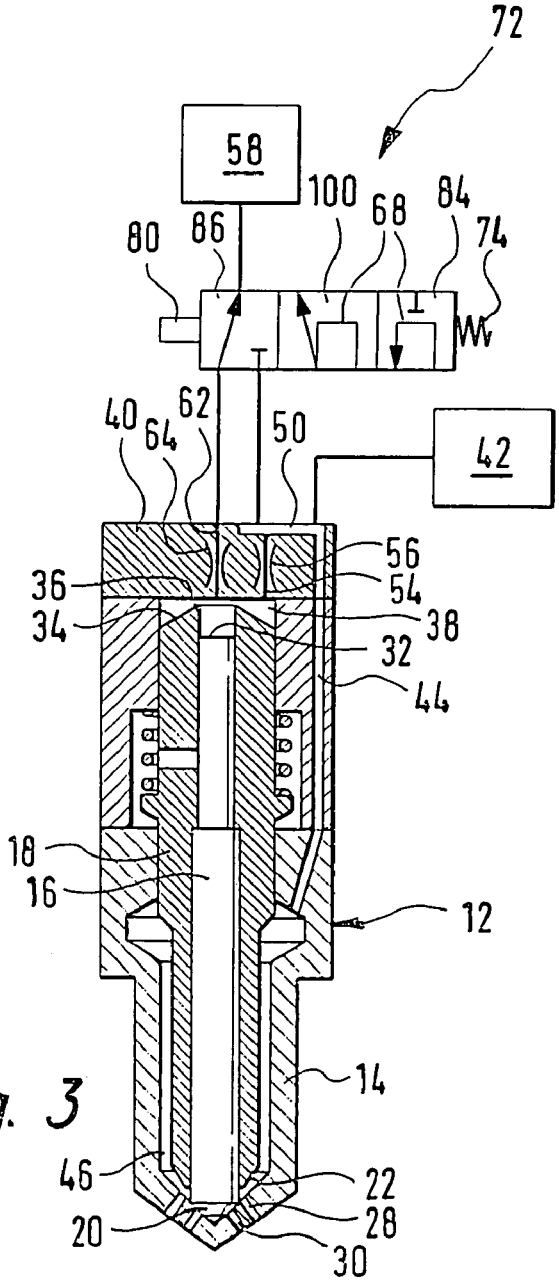
FIG. 3 is a schematic depiction similar to FIG. 2 during an opening process for opening both valve elements.

The fuel injection device 10 functions as follows:

FIGS. 1 and 2 depict an operating state of the fuel injection device 10 in which the 3/3-way relay valve 72 is in a first switched position 84 in which the switching element 70 is resting against the first valve seat 76 and is lifted away from the second valve seat 82. In this instance, the high fuel pressure in the high-pressure connection 42 is conveyed into the control chamber 38 on the one hand via the high-pressure conduit 54 and on the other hand, via the annular groove 50, the bypass conduit 68, the switching chamber 60, and the control conduit 62. As a result, the high fuel pressure that is present in the high-pressure connection 42 is also present in the control chamber 38. Correspondingly, hydraulic forces act on the control surfaces 32 and 34 in the closing direction of the valve elements 16 and 18. In addition, the valve spring 41 also acts on the outer valve element 18 in the closing direction. The control surfaces 32 and 34 are dimensioned so that the inner valve element 16 is held securely in the closed position in opposition to the combustion chamber pressure and the outer valve element 18 is held securely in the closed position in opposition to both the combustion chamber pressure and the high fuel pressure acting on the pressure surface 22.

The procedure for opening the two valve elements 16 and 18 will now be described (see FIGS. 3 and 4 and FIGS. 6 and 8):

To accomplish this, the 3/3-way relay valve 72 is brought into a second switched position 86 in which it rests against the second valve seat 82. This disconnects the switching chamber 60 from the high-pressure connection 42 and instead connects the switching chamber 60 and therefore also the control conduit 62 to the low-pressure connection 58. As a result, fuel can now flow out of the control chamber 38, through the outlet throttle 64, and to the low-pressure connection 58.

The presence of the inlet throttle 56 causes a pressure drop in the control chamber 38. This is indicated by the reference numeral 88 in FIG. 6. As soon as the pressure drops below the opening pressure of the outer valve element 18, which is higher than the opening pressure of the inner valve element 16 in the current fuel injection device 10, the hydraulic force acting on the pressure surface 22 causes the outer valve element 18 to lift away from the sealing edge 26 counter to the force of the valve spring 41 (reference numeral 89 in FIG. 8) so that the fuel can exit the pressure chamber 46 via the fuel outlet conduits 28.

Figure 4:
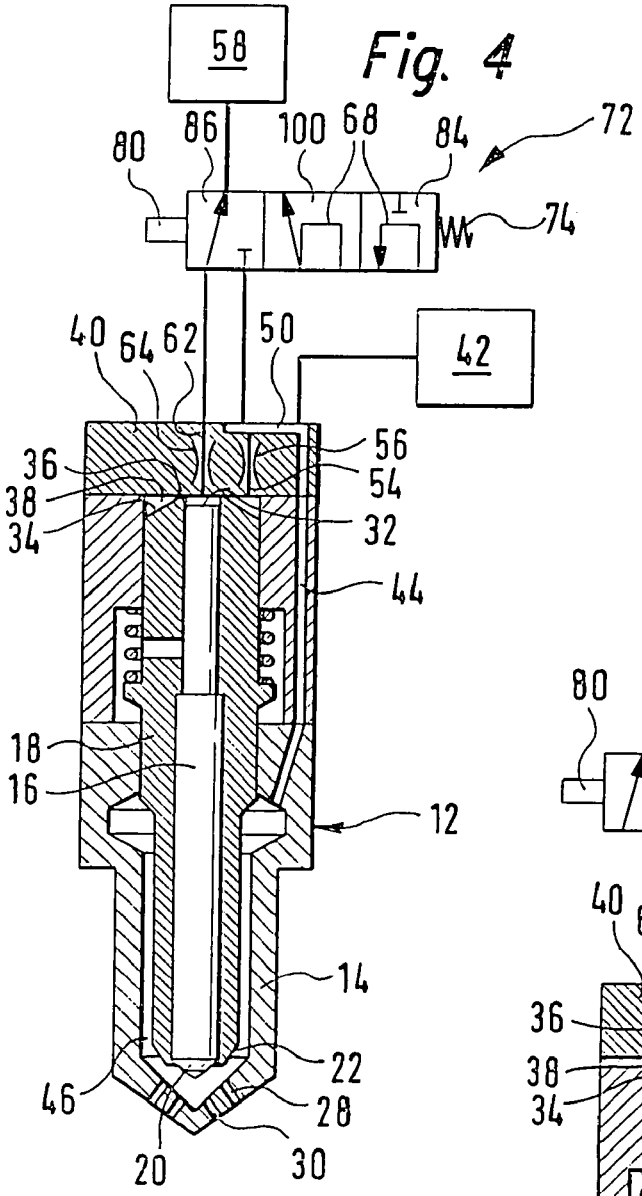
FIG. 4 is a schematic depiction similar to FIG. 2 with the valve elements open.

When the sealing region 36 of the valve element 18 comes into contact with the counterpart piece 40, (reference numeral 90 in FIG. 6), the region of the control chamber 38 situated inside the sealing edge 36 is disconnected from the influx of new fuel via the high-pressure conduit 54 or else at least restricts this influx. The pressure in this radially inner region of the control chamber 38, which continues to be connected to the low-pressure connection 58 via the control conduit 62, therefore falls further until the pressure surface 20 of the inner valve element 16 also lifts away from the sealing edge 24 (reference numeral 92 in FIG. 6 and 93 in FIG. 8). Now, fuel can also exit via the fuel outlet conduits 30. This is shown in FIG. 4.

Figure 6:
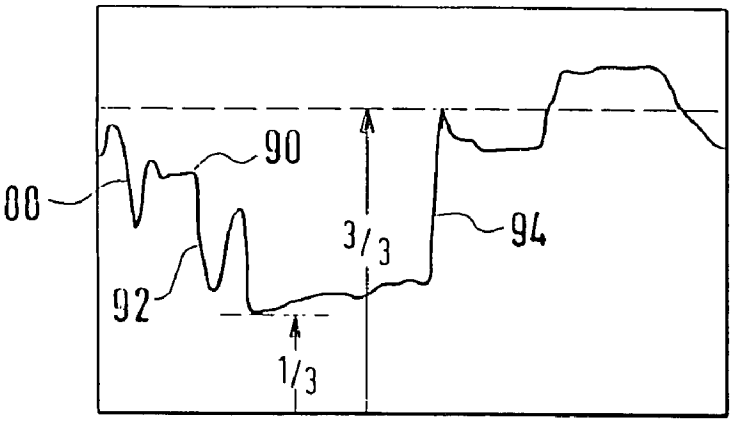
FIG. 6 is a graph depicting a pressure curve in a control chamber of the fuel injection device from FIG. 2 during the opening and closing process depicted in FIGS. 3 and 4.

FIG. 6 shows that the pressure in the control chamber 38 as a whole drops to approximately one third of its original value. This value is set by a corresponding dimensioning of the inlet throttle 56 and the outlet throttle 64. As a result, the outer valve element 18 continues to remain securely in the open position since the sealing region or sealing edge 36 is spaced slightly apart from the radially inner edge of the control surface 34 so that the region of the control surface 34 situated radially inside the sealing edge 36 is once again subjected to a very low control pressure. Furthermore, the sealing edge 36 can be embodied so that the seal between the radially outer and radially inner region of the control chamber 38 is not absolute, i.e. fuel can continue to flow out of the radially outer region of the control chamber 38, thus assuring a corresponding pressure drop therein.

The injection is terminated by bringing the switching element 70 back into contact with the first valve seat 76 (switched position 84). This disconnects the switching chamber 60 from the low-pressure connection 58 and reconnects it to the high-pressure connection 42 via the bypass conduit 68. The control chamber 38 is once again connected to the high-pressure connection 42 via the control conduit 62 and the high-pressure conduit 54, which results in a very rapid pressure increase (reference numeral 94) in the control chamber 38. As a result, both of the valve elements 16 and 18 close almost simultaneously (reference numerals 96 and 98 in FIG. 8).

Figure 5:
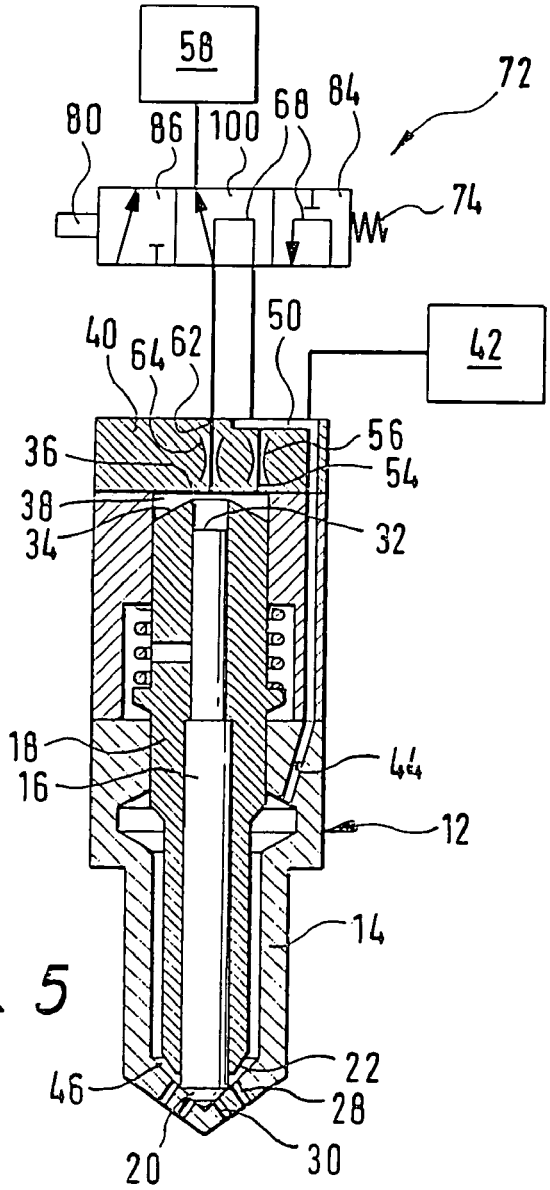
FIG. 5 is a schematic depiction similar to FIG. 2 with only one valve element open.

If only the outer valve element 18 is to be opened, then the following procedure is executed (FIG. 5):

The 3/3-way relay valve 72 is brought into a third switched position 100 in which its switching element 70 is situated in an intermediate position between the first valve seat 76 and the second valve seat 82. It is therefore resting against neither of the two valve seats 76 and 82. In this switched position 100 of the 3/3-way relay valve, the switching chamber 60 is connected to the low-pressure connection 58 on the one hand and on the other hand, is also connected to the high-pressure connection 42 via the bypass conduit 68. As a result, a pressure is set in the switching chamber 60 that is lower than the high fuel pressure in the high-pressure connection 42, but higher than the pressure that prevails in the switching chamber 60 in the switched position of the 3/3-way relay valve 72 depicted in FIGS. 3 and 4.

Figure 7:
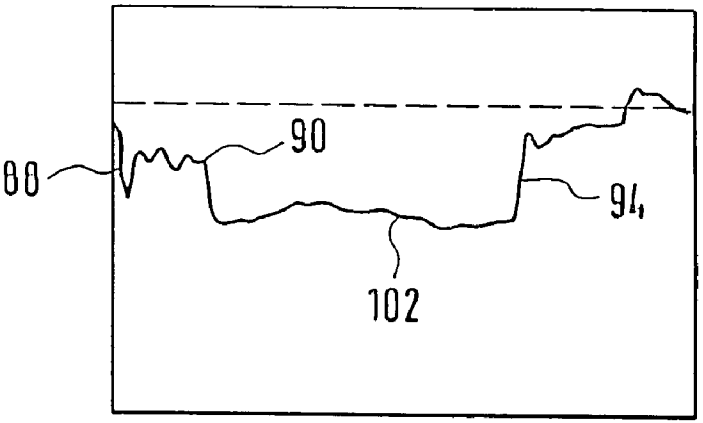
FIG. 7 is a graph similar to FIG. 6 for the case depicted in FIG. 5.
Figure 8:
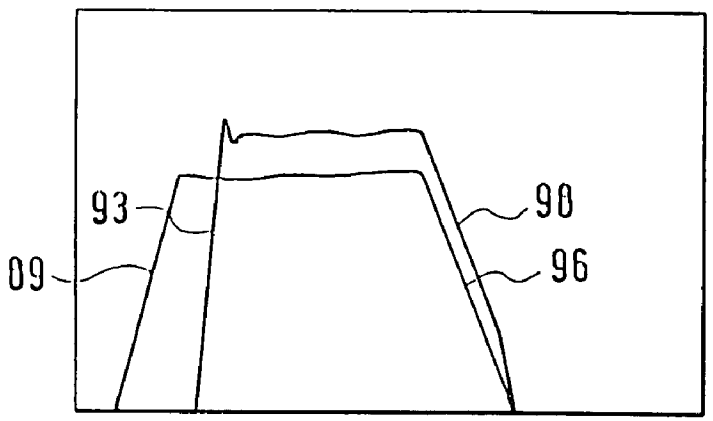
FIG. 8 is a graph depicting the curves of the switched positions of the valve elements for the pressure curve depicted in FIG. 6.
Figure 9:
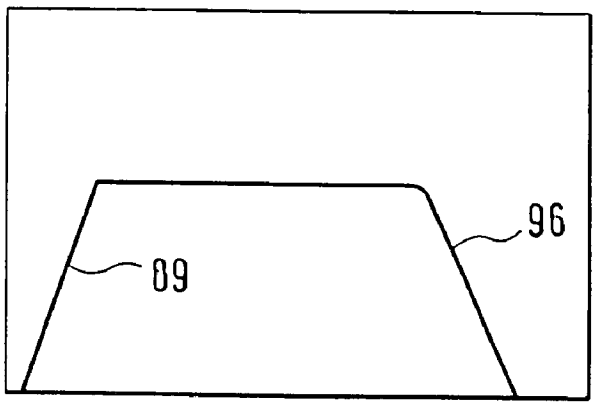
FIG. 9 is a graph similar to FIG. 8 for the pressure curve shown in FIG. 7.

The connection of the switching chamber 60 to the control chamber 38 via the control conduit 62 also reduces the pressure in the control chamber 38 (reference numeral 88 in FIG. 7), but also not as sharply as in the second switched position 86 of the 3/3-way relay valve depicted in FIGS. 3 and 4 and FIGS. 6 and 8. The corresponding region of the pressure curve is labeled with the reference numeral 102 in FIG. 7. It is clear that the pressure falls to approximately half of the initial pressure. The pressure reduction in the control chamber 38, however, is sharp enough for the outer valve element 18 to lift away from the sealing edge 26 due to the hydraulic force acting on the pressure surface 22 (reference numeral 89 in FIG. 9) so that the fuel can travel from the pressure chamber 46 to the fuel outlet conduits 28 and flow out through them. Here, too, the valve element 18 moves until its sealing edge 36 comes into contact with the counterpart piece 40 (reference numeral 90 in FIG. 7), which results in a further pressure drop in the control chamber 38, but not so sharp that the inner valve element 16 opens.

In order to accelerate the opening of the outer valve element 18, the 3/3-way relay valve 72 can also be initially brought into the second switched position 86 in which the switching element 70 rests against the second valve seat 82. The 3/3-way relay valve 72 is then brought into the third switched position 100 before the sealing region 36 of the outer valve element 18 comes into contact with the counterpart piece 40, which prevents the pressure in the control chamber 38 from dropping too sharply.

It should also be noted that the "intermediate pressure", which prevails in the switching chamber 60 when the switching element 70 is in the intermediate position 100 between the first valve seat 76 and the second valve seat 82, is also adjusted by means of the gap between the switching element 70 and the first valve seat 76. This gap constitutes a throttle that restricts the flow from the switching chamber 60 to the low-pressure connection 58.

Figure 10:
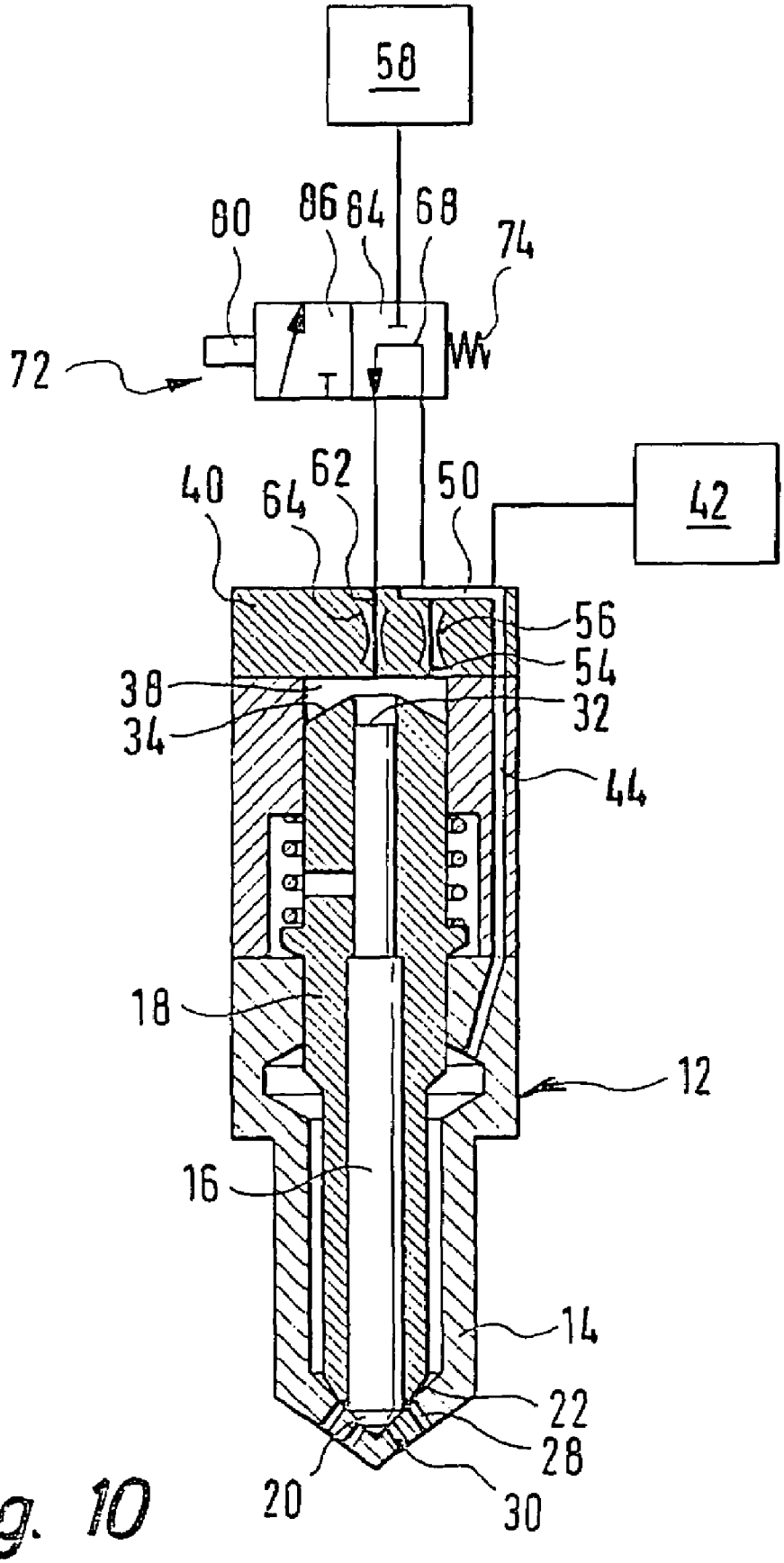
FIG. 10 is a schematic depiction similar to FIG. 2 of a second exemplary embodiment of a fuel injection device.

FIG. 10 shows a modified embodiment form of a fuel injection device 10. Here and in the figures that follow, elements and regions that have functions equivalent to elements and regions shown in the preceding figures are provided with the same reference numerals. They are not discussed in further detail.

The fuel injection device 10 shown in FIG. 10 differs from the above-described fuel injection device only in the embodiment of the relay valve 72: instead of being embodied as a 3/3-way relay valve, it is now embodied as a 3/2-way relay valve. As such, in a first switched position 84, it can connect the high-pressure connection 42 directly to the control chamber 38 via the annular groove 50, the bypass conduit 68, and the control conduit 62. In this switched position, therefore, the maximum pressure prevails in the control chamber 38, which corresponds to the pressure prevailing in the high-pressure connection 42. In the second switched position 86, however, the control chamber 38 is connected to the low-pressure connection 58 via the outlet throttle 64 and the control conduit 62. In this switched position, therefore, a comparatively low pressure prevails in the control chamber 38, which depends on how the outlet throttle 64 and the inlet throttle 56 are embodied.

As has already been explained above in connection with the exemplary embodiment shown in FIGS. 1 through 9, when high pressure prevails in the control chamber 38, both of the valve elements 16 and 18 are closed. At a low pressure, both of the valve elements 16 and 18 are opened. If only the outer valve element 18 is to be opened, then the control chamber 38 must be set to a medium pressure level. In the fuel injection device 10 shown in FIG. 10, a medium pressure level of this kind is achieved through a successive and continuous opening and closing of the relay valve 72.

Figure 11:
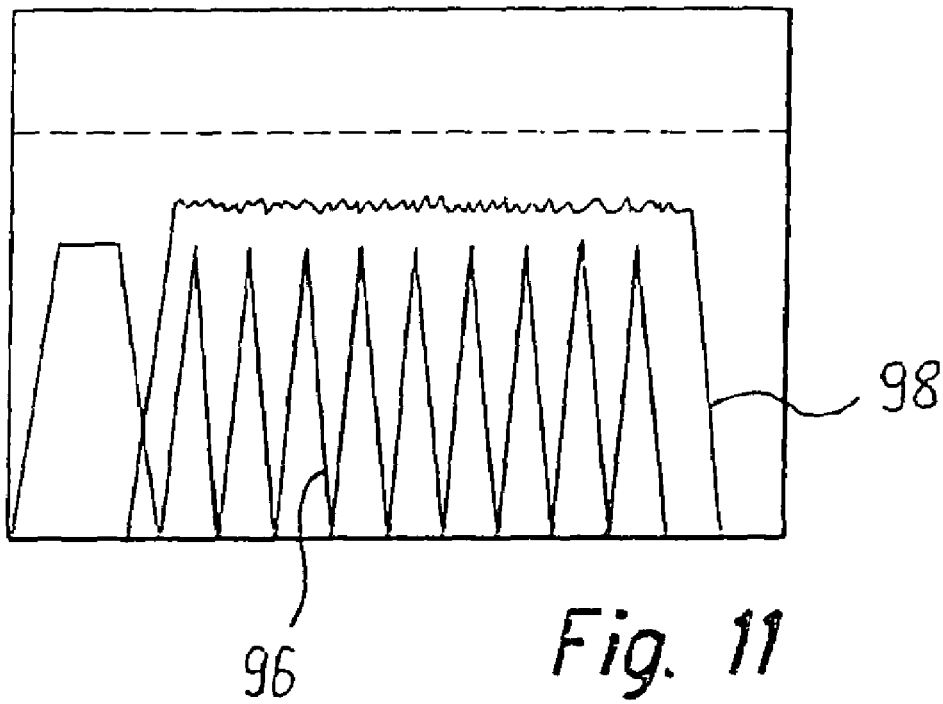
FIG. 11 is a graph depicting the position of a control valve and an outer valve element plotted over time in a first triggering variant.
Figure 12:
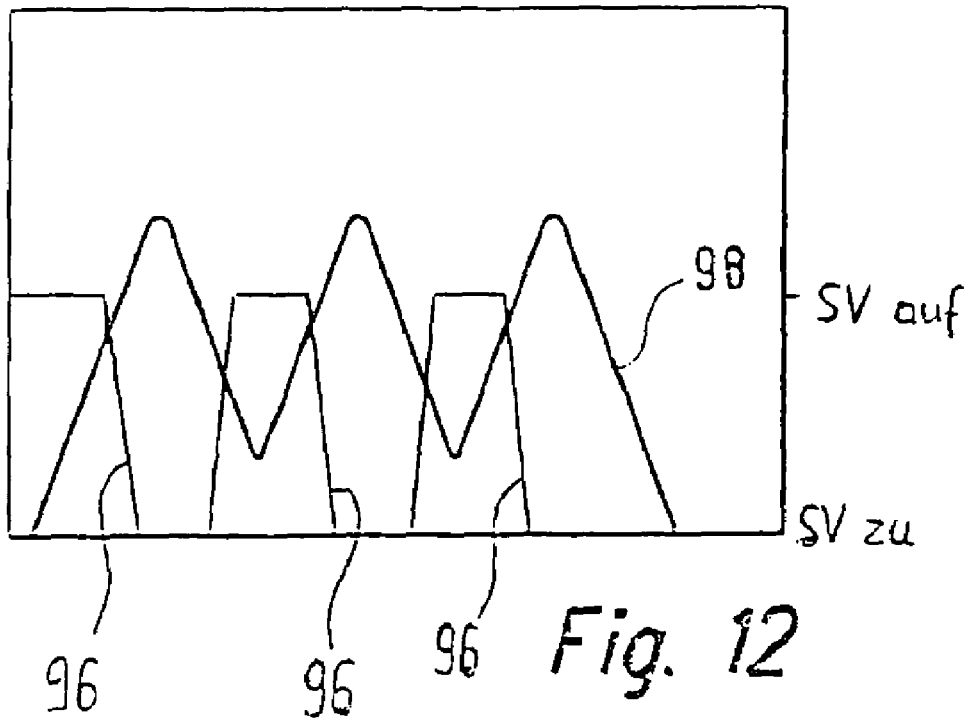
FIG. 12 is a graph depicting the position of a control valve and an outer valve element plotted over time in a second triggering variant.

As is also clear from FIGS. 11 and 12, this means that the relay valve 72 is first brought into the open switched position 86 (curve 96 in FIG. 11) so that the pressure in the control chamber 38 drops, which initially causes the outer needle 18 to open (curve 98 in FIG. 11). Shortly before or precisely at the moment that the outer valve element 18 reaches its open end position in which it comes into contact with the counterpart piece 40 (dashed horizontal line in FIG. 11), the relay valve 72 is brought back into the closed switched position 84. As a result, the pressure in the control chamber 38 rises again and the outer valve element 18 begins to execute a closing motion. But before the outer valve element 18 has closed enough to restrict the flow between the sealing edge 26 and the pressure surface 22 (see FIG. 1), the relay valve 72 is brought back into the open switched position 86. In this way, the control chamber 38 is set to a medium pressure level in that the outer valve element 18 opens, but the inner valve element 16 is still closed.

In an exemplary embodiment that is not shown, in lieu of the 3/2-way relay valve 72 depicted in FIG. 10, a 2/2-way relay valve is used. It is then possible for the corresponding fuel injection device not to have a bypass conduit so that in the closed switched position of the 2/2-way relay valve, the control conduit 62 is simply closed.

As is clear from FIG. 12, it is also possible for the relay valve 72 to be opened and closed with a very rapid switching frequency (curve 96 in FIG. 12), for example by means of a pulsed triggering. The flow cannot follow this switching action rapidly enough to yield a powerful fluctuation of the control pressure in the control chamber, but instead yields a relatively constant average pressure. As a result, the outer valve element assumes a relatively constant middle position (curve 98) close to the stop (dashed horizontal line).

Figure 13:
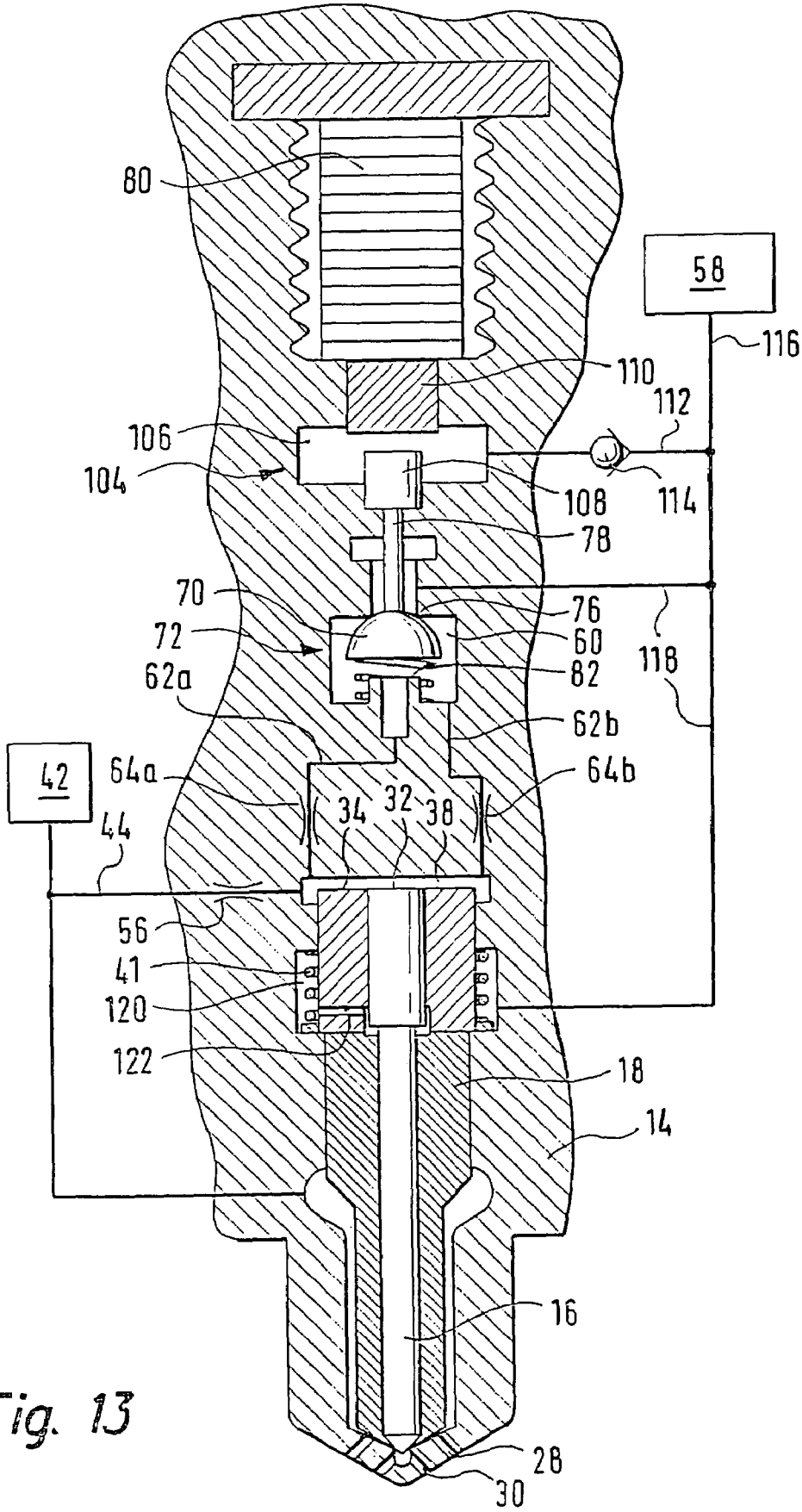
FIG. 13 is a partly schematic partial section through a region of a third exemplary embodiment of a fuel injection device.

FIG. 13 shows another possible embodiment form of a fuel injection device 10. It also has a 3/3-way relay valve 72, but does not have a bypass conduit. Instead, two parallel control conduits 62*a* and 62*b* lead from the switching chamber 60 to the control chamber 38. The one control conduit 62*a* is connected to the switching chamber 60 at the second valve seat 82. When the relay valve 72 is open, this control conduit 62*a* is thus closed. The second control conduit 62*b* is connected to the switching chamber 60 lateral to the switching element 70. The two control conduits 62*a* and 62*b* contain outlet throttles 64*a* and 64*b* that have different throttling actions.

Furthermore, in the fuel injection device 10 shown in FIG. 13, the switching element 70 is not coupled to the piezoelectric actuator 80 directly, but by means of a hydraulic booster 104. This booster has a booster chamber 106 into which a cylindrical booster element 108 protrudes on one side, which is connected to the switching element 70 by means of the actuating rod 78. A boosting body 110 coupled to the piezoelectric actuator 80 likewise protrudes into the booster chamber 106. The diameter of the boosting body 110 is greater than that of the booster element 108.

The booster chamber 106 is filled with fuel. To accomplish this, the booster chamber 106 is connected to a leakage line 116 via a branch line 112 that contains a check valve 114. This leakage line 116 leads to the low-pressure connection 58. A corresponding branch line 118 also leads to the relay valve 72 and to an annular chamber 120, which contains the compression spring 41 and into which leakage fluid can flow via a leakage conduit 122, which leakage fluid flows out of the control chamber 38 through the gap between the upper regions of the two valve elements 16 and 18. In this manner, the booster chamber 106 is supplied with the leakage fluid flowing from the control valve 72 and from the annular chamber 120.

Because of the differing diameters of the booster element 108 and the boosting body 110, a change in the length of the piezoelectric actuator 80 produces a stroke of the switching element 70 that is greater than the change in length of the piezoelectric actuator 80. If the switching element 70 is resting against the first valve seat 76, then this disconnects the two control conduits 62*a* and 62*b* from the low-pressure connection 58. As a result, a high pressure prevails in the control chamber 38 and the two valve elements 16 and 18 are closed.

If the relay valve 72 is opened so that the switching element 70 is positioned between the first valve seat 76 and the second valve seat 82, then fuel can flow out of the control chamber 38 to the low-pressure connection 58 via both of the control conduits 62*a* and 62*b*. As a result, the pressure in the control chamber 38 drops sharply so that both valve elements 16 and 18 open.

But if the switching element 70 is brought into a position in which it rests against the second valve seat 82, then the control conduit 62*a* is closed. Fuel can flow from the control chamber 38 to the low-pressure connection 58 only via the control conduit 62*b*. The outlet throttle 64*b* and the inlet throttle the 56 are matched to each other so that in this case, the control chamber 38 is set to a medium pressure level at which the outer valve element 18 does open, but the inner valve element 16 remains closed.

Figure 14:
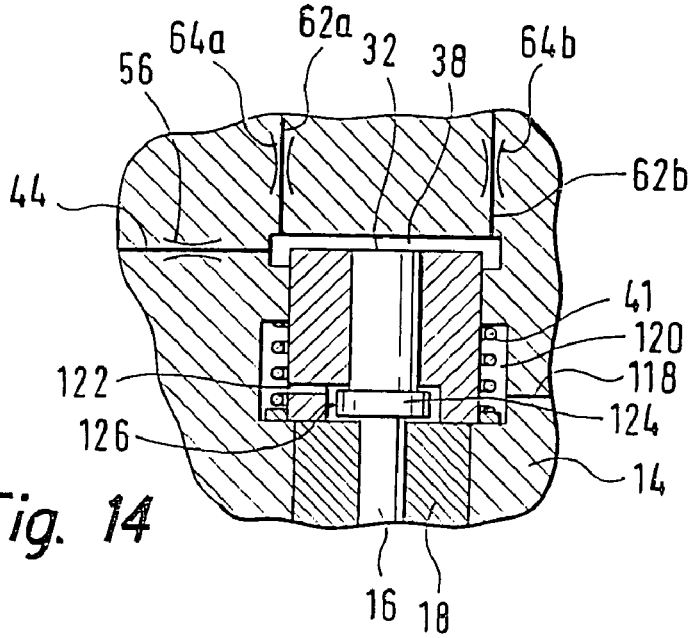
FIG. 14 shows a subregion of a modified embodiment form of the fuel injection device from FIG. 13.

FIG. 14 shows a further modified embodiment form. The differences relate to the end regions of the valve elements 16 and 18. It is clear from the drawing that the inner valve element 16 is provided with an annular collar 124 that is positioned in a recess 126 in the end region of the outer valve element 18. In the neutral position when both of the valve elements 16 and 18 are closed, the axial end surfaces of the recess 126 are spaced slightly apart from the annular collar.

The fuel injection device shown in FIG. 14 functions in a manner similar to the one shown in FIG. 13. But if the outer valve element 18 is opened, the edge surface of the recess 126 toward the bottom in FIG. 14 comes into contact with the annular collar 124. The resulting additional force that the outer valve element 18 exerts on the inner valve element 16 in the opening direction causes the inner valve element 16 to also then open. The limit surface of the recess 126 on the outer valve element 18, which surface is situated toward the bottom in FIG. 14, therefore functions as a catch that drives the inner valve element 16.

The axial positions of the annular collar 124 and the recess 126 are matched to each other so that the lower edge of the recess 126 only strikes the annular collar 124 of the inner valve element 16 shortly before the outer valve element 18 reaches its maximum stroke. This permits the achievement of a stepped injection rate ("boot injection"), which makes it possible to reduce emissions of the internal combustion engine in which the fuel injection device 10 is used. The control surface 32 of the inner valve element 16 is also designed so that even when both control conduits 62*a* and 62*b* are "activated", i.e. when the minimum possible pressure is present in the control chamber 38, the inner valve element 16 only opens after the recess 126 has struck the annular collar 124.

Figure 15:
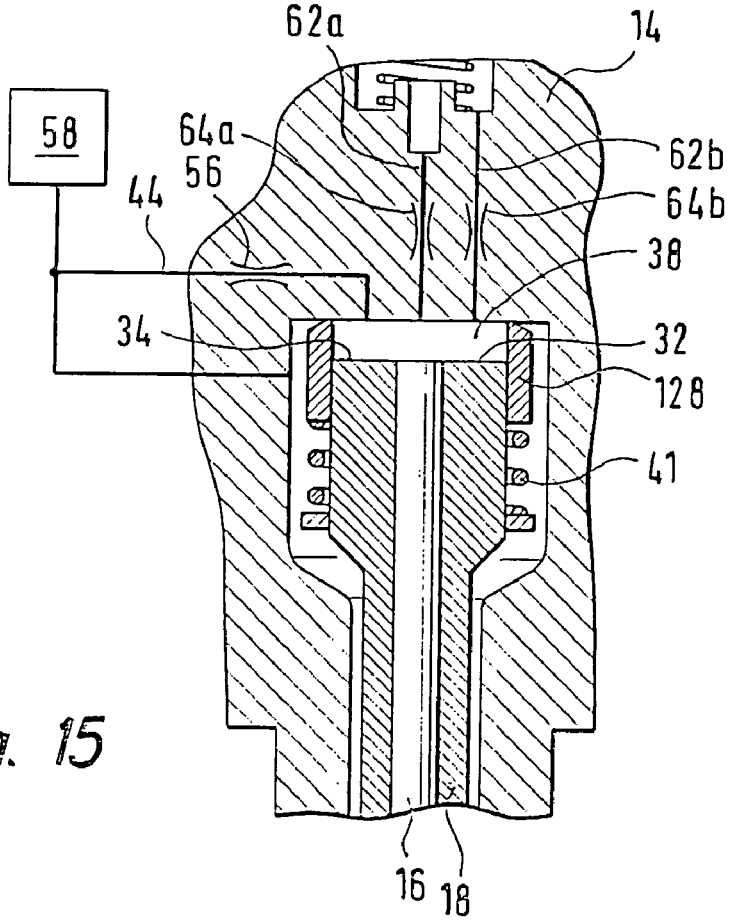
FIG. 15 shows a subregion of a further modified embodiment form of the fuel injection device from FIG. 13.

FIG. 15 shows a further modified embodiment form of the fuel injection device 10. In this embodiment form, the valve elements 16 and 18 are each embodied of one piece. The control chamber 38 is delimited radially not by the housing 12, but by a sleeve 128, which has a sealing edge (unnumbered) at its edge toward the top in FIG. 15. The compression spring 41 presses this sealing edge against the housing surface (unnumbered) opposite from the control surfaces 32 and 34 of the valve elements 16 and 18.

The foregoing relates to a preferred exemplary embodiment of the invention, it being understood that other variants and embodiments thereof are possible within the spirit and scope of the invention, the latter being defined by the appended claims.

The invention claimed is:

1. In a fuel injection device for an internal combustion engine, having at least two valve elements, each of which has a hydraulic control surface acting in the closing direction associated with a hydraulic control chamber, having a control valve that influences the pressure in the control chamber, and having loading devices that are able to act on the valve elements in the opening direction, in which the valve elements react at different hydraulic opening pressures prevailing in the control chamber, the improvement wherein the control valve is able to set at least three different pressure levels in the control chamber; wherein all of the valve elements are closed at a comparatively high pressure level; wherein one valve element is open at a medium pressure level; and wherein all of the valve elements are open at a comparatively low pressure level.

2. The fuel injection device according to claim 1, wherein the control chamber is connected both to a high-pressure connection via an inlet throttle and the control valve is connected both to the control chamber and to a low-pressure connection.

3. The fuel injection device according to claim 2, wherein the control valve comprises a switching chamber with a switching element, which rests against a first valve seat leading to the low-pressure connection in a first switched position, rests against a second valve seat leading to a bypass conduit in a second switched position, in which position the bypass conduit is connected to the high-pressure connection, and does not rest against either the first valve seat or the second valve seat in a third switched position.

4. The fuel injection device according to claim 3, wherein in the third switched position, the control valve constitutes a throttle that restricts the flow toward the low-pressure connection.

5. The fuel injection device according to claim 1, wherein the control chamber is connected to the high-pressure connection, the control valve is connected to the control chamber via at least two control conduits, and wherein the control valve disconnects all of the control conduits from a low-pressure connection in a first switched position, connects one control conduit to the low-pressure connection in a second switched position, and connects all of the control conduits to the low-pressure connection in a third switched position.

6. The fuel injection device according to claim 2, wherein the control chamber is connected to the high-pressure connection, the control valve is connected to the control chamber via at least two control conduits, and wherein the control valve disconnects all of the control conduits from a low-pressure connection in a first switched position, connects one control conduit to the low-pressure connection in a second switched position, and connects all of the control conduits to the low-pressure connection in a third switched position.

7. The fuel injection device according to claim 2, wherein the control chamber is connected to a high-pressure connection, wherein the control valve connects the control chamber to a low-pressure connection in a first switched position and disconnects the control chamber from it in a second switched position, and wherein it is possible to continuously switch the control valve back and forth between the first switched position and the second switched position.

8. The fuel injection device according to claim 7, wherein it is possible to trigger the control valve so that the continuous changing causes the pressure in the control chamber to fluctuate around a medium pressure level.

9. The fuel injection device according to claim 7, wherein it is possible to trigger the control valve quickly so that the continuous changing yields a substantially constant, medium pressure level.

10. In a fuel injection device for an internal combustion engine, having at least two valve elements, each of which has a hydraulic control surface acting in the closing direction associated with a hydraulic control chamber, having a control valve that influences the pressure in the control chamber, and having loading devices that are able to act on the valve elements in the opening direction, in which the valve elements react at different hydraulic opening pressures prevailing in the control chamber, the improvement wherein the control valve is able to set at least three different pressure levels in the control chamber; wherein all of the valve elements are closed at a comparatively high pressure level; wherein one valve element is open at a medium pressure level; wherein all of the valve elements are open at a comparatively low pressure level; and wherein the valve elements are coaxial to each other and an axial boundary surface of the control chamber has a sealing region which, in an open end position of the outer valve element, subdivides the control chamber into an outer region connected to the high-pressure connection and an inner region connected to the control valve.

11. In a fuel injection device for an internal combustion engine, having at least two valve elements, each of which has a hydraulic control surface acting in the closing direction associated with a hydraulic control chamber, having a control valve that influences the pressure in the control chamber, and having loading devices that are able to act on the valve elements in the opening direction, in which the valve elements react at different hydraulic opening pressures prevailing in the control chamber, the improvement wherein the control valve is able to set at least three different pressure levels in the control chamber; wherein all of the valve elements are closed at a comparatively high pressure level; wherein one valve element is open at a medium pressure level; wherein all of the valve elements are open at a comparatively low pressure level, wherein the control chamber is connected both to a high-pressure connection via an inlet throttle and the control valve is connected both to the control chamber and to a low-pressure connection; and wherein the valve elements are coaxial to each other and an axial boundary surface of the control chamber has a sealing region which, in an open end position of the outer valve element, subdivides the control chamber into an outer region connected to the high-pressure connection and an inner region connected to the control valve.

12. The fuel injection device according to claim 1, wherein the control valve includes a piezoelectric actuator.

13. The fuel injection device according to claim 2, wherein the control valve includes a piezoelectric actuator.

14. The fuel injection device according to claim 12, wherein the control valve includes a valve body that is hydraulically coupled to the piezoelectric actuator; and wherein leakage fuel emerging from a guide of at least one valve element is used as the hydraulic fluid.

15. The fuel injection device according to claim 1, further comprising a catch on one valve element that acts on the other valve element in the opening direction.

16. The fuel injection device according to claim 15, wherein the catch is embodied so that it strikes the other valve element shortly before the one valve element reaches its maximum stroke.

17. The fuel injection device according to claim 15, wherein the loading device acting in the opening direction of the other valve element and the hydraulic control surface of the other valve element are matched to each other so that this valve element opens only if the catch of the one valve element exerts an additional force acting in the opening direction.

18. A method for operating a fuel injection device, said fuel injection device comprising at least two valve elements, each of which has a hydraulic control surface acting in the closing direction associated with a hydraulic control chamber, a control valve that influences the pressure in the control chamber, and loading devices that are able to act on the valve elements in the opening direction, in which the valve elements react at different hydraulic opening pressures prevailing in the control chamber, the method comprising the steps of first connecting the control chamber to a low-pressure connection and then, simultaneously connecting the control chamber to the low-pressure connection and a high-pressure connection in order to open only one valve element.

19. A method for operating a fuel injection, said fuel injection device comprising at least two valve elements, each of which has a hydraulic control surface acting in the closing direction associated with a hydraulic control chamber, a control valve that influences the pressure in the control chamber, and loading devices that are able to act on the valve elements in the opening direction, in which the valve elements react at different hydraulic opening pressures prevailing in the control chamber, the method comprising the steps of first connecting the control chamber to the low-pressure connection and then, additionally connecting the control chamber to the high-pressure connection in order to open only one valve element.

20. A method for operating a fuel injection device, said fuel injection device having at least one outer and one inner valve element, the valve elements being arranged coaxially and each of which having a hydraulic control surface acting in the closing direction associated with a hydraulic control chamber, having a control valve that influences the pressure in the control chamber, and having loading devices that are able to act on the valve elements in the opening direction, in which the valve elements react at different hydraulic opening pressures prevailing in the control chamber, wherein the control chamber is connected both to a high-pressure connection via an inlet throttle and the control valve is connected both to the control chamber and to a low-pressure connection, and wherein the control chamber is connected to a high-pressure connection, wherein the control valve connects the control chamber to a low-pressure connection in a first switched position and disconnects the control chamber from it in a second switched position, and wherein it is possible to continuously switch the control valve back and forth between the first switched position and the second switched position, the method comprising closing the control valve shortly before the pressure in the control chamber has fallen far enough for the inner valve element to open, and opening the control valve again shortly before the outer valve element closes.

* * * * *